United States Patent [19]

Moson

[11] Patent Number: 5,054,579

[45] Date of Patent: Oct. 8, 1991

[54] LADDER HAVING AN ANCHORING SYSTEM

[76] Inventor: John A. Moson, 21C Maple Ave., Little Compton, R.I. 02837

[21] Appl. No.: 571,785

[22] Filed: Aug. 24, 1990

[51] Int. Cl.[5] ..... E06C 5/36; E06C 7/46

[52] U.S. Cl. ..... 182/107; 182/93; 248/508

[58] Field of Search ..... 182/107, 108, 109, 111, 182/93; 135/118; 248/508, 530, 156

[56] References Cited

U.S. PATENT DOCUMENTS

| | | | |
|---|---|---|---|
| 427,815 | 5/1890 | Wolf | 135/118 |
| 776,446 | 11/1904 | Williamson | 182/107 |
| 1,127,087 | 2/1915 | Phillips | 135/118 |
| 1,352,323 | 9/1920 | Stephan . | |
| 2,145,619 | 1/1939 | Brown | 182/107 |
| 2,523,535 | 9/1950 | Little | 182/107 |
| 2,936,849 | 5/1960 | Larson . | |
| 2,993,561 | 7/1961 | Watson | 182/107 |
| 3,280,829 | 10/1966 | Glendenning | 135/118 |
| 4,576,250 | 3/1986 | Marish | 182/108 |
| 4,852,689 | 8/1989 | Erion | 182/204 |
| 4,941,547 | 7/1990 | Livick | 182/107 |

*Primary Examiner*—Reinaldo P. Machado
*Attorney, Agent, or Firm*—Donald J. Breh

[57] ABSTRACT

A ladder having an anchoring system is disclosed including a ladder and stakes to be driven into the ground which are engagable against an upwardly facing surface of the ladder in the normal position of use. According to preferred embodiments, the ladder is provided with a pair of apertures either in the lower most rung, the side rails or in laterally extending flanges through which the anchoring stakes are received.

5 Claims, 1 Drawing Sheet

LADDER HAVING AN ANCHORING SYSTEM

BACKGROUND OF THE INVENTION

This invention relates to ladders. More particularly, the invention relates to safety devices for a ladder and in still greater particularity, to a ladder including an anchoring system.

It is well known that ladders and in particular extension type ladders present significant safety concerns. Such ladders especially long ladders and those when fully extended become increasingly unstable, particularly in regard to their likelihood to slip or bounce or otherwise move on the ground which of course presents a significant safety hazard to the user.

Devices either anchoring ladders to the ground or decreasing their likelihood to slip exist and typically include enlarged or non-skid high friction pads or feet on the lower end of the ladder such as those shown in U.S. Pat. Nos. 4,852,689 and 2,936,849. These devices are particularly effective on non-earth, hard, smooth support surfaces and, although reduce the likelihood of slipping, they do not provide for positive anchoring of the ladder. Another device which does provide for more positive anchoring is disclosed in U.S. Pat. No. 1,352,323. That device includes a pair of oppositely extending pivotable arms carrying spring biased spikes attached to the side rails of the ladder which extend fore and aft of the ladder and which are pushed into the earth. Although, as noted, this device provides for more positive lateral and fore and aft restraint, it does not provide for effective upward restraint of the ladder. Further, the device is rather complicated requiring various springs, pins and lever arms and pivot shafts which is not desirable.

SUMMARY OF THE INVENTION

It is the object of the present invention to provide for a combination ladder and anchoring system which is uncomplicated and effective in positively restraining ladders against inadvertant movement in all directions.

According the invention, the ladder is provided with stake means adapted to be driven into the ground and to engage an upwardly facing surface of the ladder in the normal upright in use position of the ladder.

According to one embodiment of the invention, the stake means includes a J-shaped stake where the curved portion of the stake is adapted to engage over a lower most rung of the ladder when the stake is driven into the ground.

According to another feature of the invention, the lower portion of the ladder is provided with at least one hole through which a stake may be inserted and driven into the ground with an enlarged end of the stake engaged against an upwardly facing portion of the ladder at the hole.

According to a preferred embodiment, the hole is provided in a lower most rung of the ladder.

According to another embodiment, a pair of holes are provided, one in each side rail of the ladder, with a stake angularly downwardly and inwardly insertable through each hole to be driven into the ground. An enlarged end of each stake engages against each side rail at each hole.

According to another embodiment, there is provided a pair of flanges extending outwardly away from each side rail including a hole for receiving a stake.

A BRIEF DESCRIPTION OF THE DRAWINGS

The invention will be better understood after reading the following Detailed Description of the Preferred Embodiment in conjunction with the drawings in which.

DETAILED DESCRIPTION OF THE PREFERRED EMBODIMENT

Figure 1:
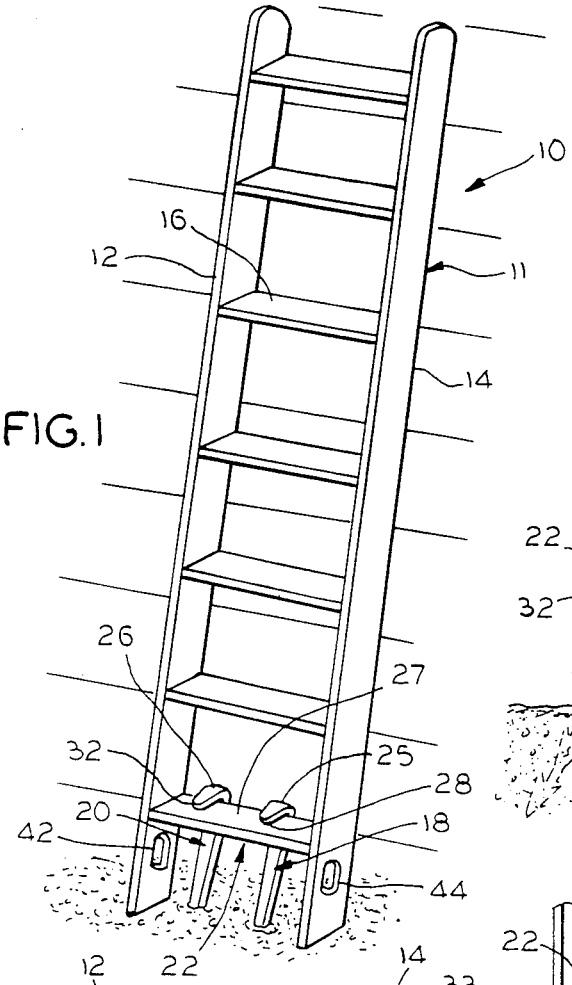
FIG. 1 is a pictorial view of a ladder including an anchoring system according to the invention showing details of construction and use.

Shown in FIG. 1 is ladder and anchoring system 10 including a ladder 11 of the type including a pair of side rails 12, 14 and a plurality of rungs 16. The invention is contemplated to be most useful in connection with extention-type ladders as opposed to folding or step-type ladders since extension ladders are typically raised to substantial heights and are less stable than folding-type ladders, however, the invention can be used in connection with folding-type ladders also.

The anchoring system includes at least one and preferrably two elongated stakes 18, 20 which have a portion 24 adapted to be driven into the ground and a portion adapted to engage around, over or otherwise against an upwardly facing surface 27 of the ladder when the ladder is in it's normal position of use as shown in FIG. 1. Many forms of stakes and means for engaging an upwardly facing surface are possible and those shown and described here are representative of preferred stake structures.

FIG. 1 shows a pair of L-shaped stakes 18, 20 having flanges which engage over a lower most rung 22 of the ladder when driven into the ground to securely anchor the ladder. This embodiment is particularly suited for use with existing ladders since no modification of the ladder is required.

Figure 8:
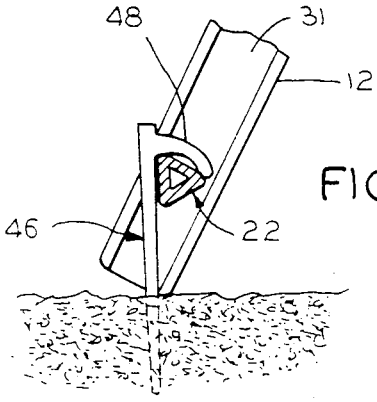
FIG. 8 is a vertical cross sectional view through a lower rung portion of a ladder showing details of construction of yet another embodiment of the invention.

Another embodiment which does not require modification to the ladder and is accordingly particularly suited for use with existing ladders is shown in FIG. 8. In that embodiment, the stake includes a J-shaped stake 46 wherein the curved portion 48 of the stake is engagable over the top of the lower most rung of the ladder.

More positive anchoring of the ladder is achieved by the systems according to FIGS. 2 and 3, 4 and 5 and 6 and 7. Although existing ladders can be adapted to include these anchoring systems by providing the appropriate holes and flanges to accept the anchoring stakes, the systems are particularly suited for inclusion into new ladders which can be designed and manufactured to include the anchoring stake receiving holes without comprimising the strength of the ladder.

Figure 2:
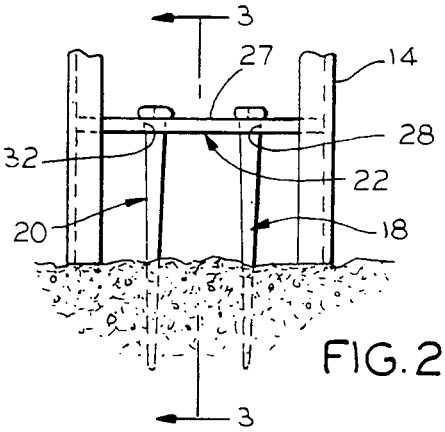
FIG. 2 is a front view of the lower rung portion of a ladder showing details of the ladder and anchoring system according to the invention.
Figure 3:
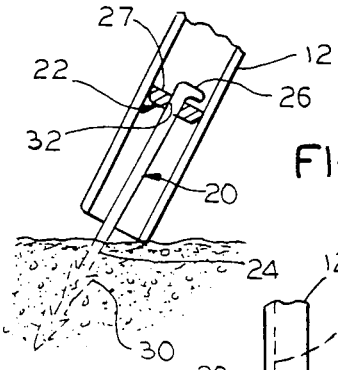
FIG. 3 is a vertical cross sectional view taken along the line 3—3 in FIG. 2 showing details of construction of a preferred embodiment.
Figure 5:
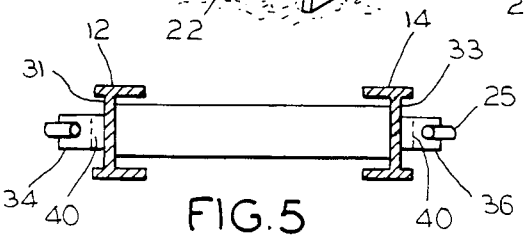
FIG. 5 is a top view of the ladder in FIG. 4 showing further details of construction.

As shown in FIGS. 2 and 3, the lower most rung 22 of the ladder is provided with a pair of holes 28, 32 through which the anchoring stakes 18, 20 are insertable for being driven into the ground. Enlarged heads 25, 26 engage against the upwardly facing surface 27 of the lower most rung when the ladder is positioned in it's upright in use position. It can be seen that the ladder is therefore positively anchored to the ground and is restrained against movement in substantially all directions including the vertical or upward direction. FIG. 3 further shows that the anchoring portion of the stake can include a plurality of barbs 30 to increase the vertical holding power of the stake.

Figure 4:
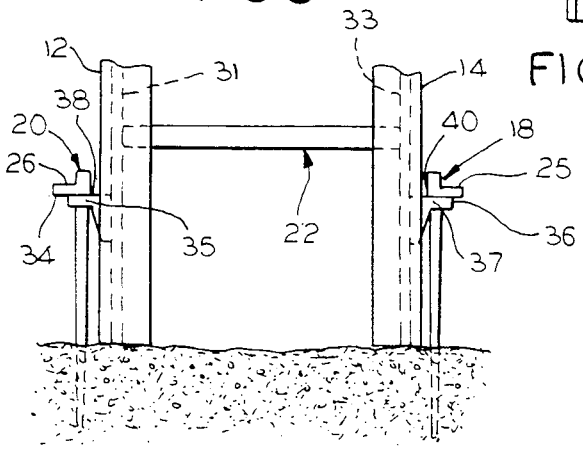
FIG. 4 is a front view of the lower rung portion of a ladder showing details of construction of an alternative embodiment.

Another embodiment is shown in FIGS. 2 and 4 wherein a pair of outwardly extending flanges 34, 36 are affixed to the outer surfaces of each side rail web 31, 33. Each flange 34, 36 is provided with an upwardly opening [in the normal use position of the ladder] hole 35, 37. As shown in FIG. 4, stakes 18, 20 are inserted through the holes 35, 37 and driven into the ground with the enlarged portion of the stake 25, 26 engaging the upwardly facing surfaces 38, 40 of the flanges.

Figure 7:
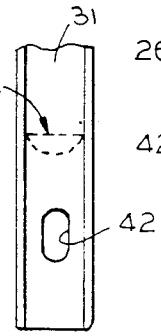
FIG. 7 is a side-view of the ladder of FIG. 6 showing further details of construction.
Figure 6:
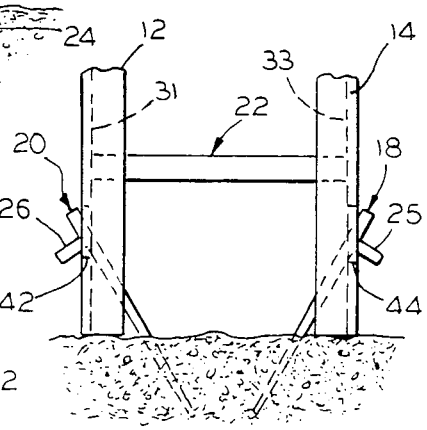
FIG. 6 is a front view of the lower rung portion of a ladder showing details of construction of another embodiment of the invention.

The embodiment shown in FIGS. 6 and 7 includes a pair of holes 42, 44; one provided in each web 31, 33 below the lower most rung 22. As shown in FIGS. 1 and 7, the holes 42, 44 are preferrably oblong or vertically elongated so as to provide for insertion of the stakes 18, 20 in an angularly downwardly and inwardly direction relative to the ladder in it's in use position so as to be driven into the ground as shown in FIG. 6. When driven into the ground, the enlarged heads 25, 26 engage against the webs 31, 33 in the holes 42, 44 to provide positive anchoring.

The embodiment of FIGS. 4–7 both locate the anchoring stakes outward of the ladder and accordingly leave the rung 22 unobstructed and eliminates the possibility of the user tripping on the anchoring stakes, however, all of the anchoring systems provide for effective positive restraint and anchoring of the ladder to the ground. The system is easy to use in that the user only need be provided with at least one stake adapted to engage an upwardly facing surface of the ladder preferrably at a hole provided in the ladder when the ladder is in it's normal use position and the stake is driven into the ground.

Having described the preferred embodiment of the invention, those skilled in the art, having the benefit of the description and accompanying drawings can readily devise other embodiments and modifications which are to be considered to be within the scope of the appended claims.

What is claimed is:

1. A ladder having an anchoring system comprising in combination:

a ladder including a pair of rails supporting a plurality of parallél spaced apart rungs, said ladder having a lower end to be positioned on the ground with the side rails extending upwardly in a normal position of use of the ladder and a lowermost rung of the ladder in said normal position of use including at least one aperture; and at least one stake adapted to be inserted through said at least one aperture in said lowermost rung including a first portion adapted to be driven into the ground and a second portion adapted to engage an upwardly facing portion associated with the lowermost rung in said normal upwardly extending position of use of the side rails with said first portion driven in the ground for anchoring the lower end of said ladder to the ground against movement in substantially all directions.

2. The ladder and anchoring system as defined in claim 1 wherein said stake is generally L-shaped including a lateral offset defining said second portion of the stake.

3. A ladder having an anchoring system comprising:

a ladder including a pair of side rails and two holes, one hole in each of said side rails below a lowermost rung of the ladder in a normal position of use of the ladder; and two stakes, one adapted to be inserted through each of said two holes in said side rails, each stake including a first portion adapted to be driven into the ground and a second portion adapted to engage against a respective side rail at said respective hole in the normal position of use.

4. The ladder and anchoring system as defined in claim 3 wherein each of said two holes and each of said stakes are relatively sized such that each stake is receivable through said hole in a direction angularly downwardly and inwardly relative to said side rails in the position of use of the ladder with said second portion of said stake disposed at an external side of the side rail.

5. A method of anchoring a ladder to the ground comprising the steps:

positioning a ladder having an aperture in a lowermost rung in a normal upwardly extending position of use;

inserting a stake including a portion adapted to be driven into the ground and a portion adapted to engage an upwardly facing portion of the lowermost rung through said aperture; and driving the stake into the ground with said portion adapted to engage said upwardly facing portion against said upwardly facing portion whereby, said ladder is pulled toward said ground and is restrained against movement.

* * * * *